US011486662B2

(12) United States Patent
Joyce et al.

(10) Patent No.: US 11,486,662 B2
(45) Date of Patent: Nov. 1, 2022

(54) INTERNAL DEGAS FEATURE FOR PLATE-FIN HEAT EXCHANGERS

(71) Applicant: Hanon Systems, Daejeon (KR)

(72) Inventors: Stephen Joyce, Surrey (GB); Leo Somhorst, Chislehurst (GB); Alex McDonnell, Essex (GB)

(73) Assignee: HANON SYSTEMS, Daejeon (KR)

( * ) Notice: Subject to any disclaimer, the term of this patent is extended or adjusted under 35 U.S.C. 154(b) by 25 days.

(21) Appl. No.: 16/278,238

(22) Filed: Feb. 18, 2019

(65) Prior Publication Data

US 2019/0178589 A1 Jun. 13, 2019

Related U.S. Application Data

(62) Division of application No. 14/965,937, filed on Dec. 11, 2015, now Pat. No. 10,309,732.

(51) Int. Cl.

| | |
|---|---|
| ***F28D 9/00*** | (2006.01) |
| ***F28D 1/03*** | (2006.01) |
| ***F28F 13/00*** | (2006.01) |
| *F28D 21/00* | (2006.01) |

(52) U.S. Cl.

CPC ..... *F28F 13/00* (2013.01); *F28D 9/0056* (2013.01); *F28D 9/0093* (2013.01); *F28D 1/0341* (2013.01); *F28D 9/005* (2013.01); *F28D 2021/0082* (2013.01); *F28F 2265/18* (2013.01)

(58) Field of Classification Search

CPC ..... F28D 20/003; F28D 1/0341; F28D 9/005; F28D 13/00

USPC ..... 165/166–167, 104.32

See application file for complete search history.

(56) References Cited

U.S. PATENT DOCUMENTS

| | | | | |
|---|---|---|---|---|
| 1,770,254 A * | 7/1930 | Seligman | A23L 3/20 | 165/103 |
| 2,314,966 A * | 3/1943 | Astle | F28F 3/083 | 165/167 |
| 3,258,832 A * | 7/1966 | Gerstung | F28D 1/0333 | 29/890.039 |
| 3,946,804 A * | 3/1976 | Tkach | C01D 7/18 | 165/167 |
| 4,011,905 A * | 3/1977 | Millard | F28D 1/0333 | 165/175 |
| 4,370,868 A * | 2/1983 | Kim | F25B 39/022 | 165/153 |

(Continued)

FOREIGN PATENT DOCUMENTS

| | | |
|---|---|---|
| CN | 1230250 A | 9/1999 |
| DE | 102007038894 A1 | 4/2008 |

(Continued)

*Primary Examiner* — Paul Alvare

(74) *Attorney, Agent, or Firm* — Shumaker, Loop & Kendrick, LLP; James D. Miller

(57) ABSTRACT

A heat exchange assembly includes an upper cover panel, a lower cover panel, a plurality of stacked plate assemblies, and a plurality of fins interposed between the plurality of plate assemblies. Each of the plurality of plate assemblies forms a flow passage for receiving a coolant. A continuous flow path extends through the heat exchange assembly. The flow path is in fluid communication with the flow passage of each of the plates and configured to convey air from each of the flow passages to an environment separate from the heat exchanger.

17 Claims, 3 Drawing Sheets

(56) References Cited

U.S. PATENT DOCUMENTS

| | | | | | |
|---|---|---|---|---|---|
| 4,443,188 | A * | 4/1984 | Buhler | F28D 7/12 | 432/233 |
| 4,712,158 | A * | 12/1987 | Kikuchi | H01L 23/4735 | 361/699 |
| 5,448,899 | A * | 9/1995 | Ohara | F25B 39/022 | 165/153 |
| 5,810,074 | A * | 9/1998 | Hancock | F28D 1/0477 | 165/112 |
| 5,921,085 | A * | 7/1999 | Kawano | F28B 9/10 | 60/646 |
| 6,568,466 | B2 * | 5/2003 | Lowenstein | F28D 5/00 | 165/153 |
| 7,072,180 | B2 * | 7/2006 | Nishiura | H05K 7/20218 | 361/699 |
| 2004/0177950 | A1 * | 9/2004 | Gluck | F28D 9/005 | 165/166 |
| 2005/0211421 | A1 * | 9/2005 | Ekelund | F28D 9/005 | 165/114 |
| 2014/0246179 | A1 * | 9/2014 | Vallee | F28F 3/12 | 165/109.1 |
| 2017/0038168 | A1 * | 2/2017 | Arndt | F28D 9/0056 | |
| 2017/0227295 | A1 * | 8/2017 | Kalbacher | F28F 9/0256 | |

FOREIGN PATENT DOCUMENTS

| | | | |
|---|---|---|---|
| JP | 2013111640 | A | 6/2013 |
| KR | 20050110621 | A | 11/2005 |
| KR | 20140089529 | A | 7/2014 |

* cited by examiner

INTERNAL DEGAS FEATURE FOR PLATE-FIN HEAT EXCHANGERS

CROSS REFERENCE TO RELATED PATENT APPLICATIONS

This patent application is a divisional patent application of U.S. Pat. Appl. Ser. No. 14/965,937 filed Dec. 11, 2015, hereby incorporated herein by reference in its entirety.

FIELD OF THE INVENTION

The invention relates to a degas feature of a plate-fin heat exchanger, particularly to a degas feature of a plate-fin heat exchanger including plates with a multiple pass configuration.

BACKGROUND OF THE INVENTION

As is commonly known, plate-fin heat exchangers such as a water-cooled charge air coolers (WCAC) can be used in a motor vehicle to cool air that has been compressed by a turbocharger or a supercharger prior to entering an engine of the vehicle. Typically, the plate-fin heat exchangers include a heat exchange core having a plurality of plates interposed with a plurality of fins. The plates form passages for receiving a coolant from a coolant circuit of the motor vehicle. As the compressed air flows through the heat exchanger, heat is transferred between the compressed air and the coolant.

In certain situations, undesired air may also be inadvertently introduced in the passages formed by the plates. For example, when coolant is introduced to the heat exchanger during a servicing or maintenance of the heat exchanger, undesired air may begin to accumulate and become trapped in the passages formed by the plates. The accumulation of the air minimizes the efficiency and performance of the heat exchanger.

To solve the problem of trapped air in the passages formed by the plates of the heat exchanger, the heat exchanger may include a bleed screw or bleed valve disposed at a coolant outlet spout of the heat exchanger to purge the air from the passages. However, in heat exchangers with plates including passages having multiple parallel pass configurations such as four, six, eight, or ten pass configurations, for example, the bleed screw or bleed valve disposed at the coolant outlet spout is ineffective in purging the air from all the passes of the passages. As a result, the heat exchanger performance and efficiency is adversely affected.

It would therefore be desirable to provide a plate-fin heat exchanger with plates that form a degas flow path that effectively convey and purge undesired air from all passages of the heat exchanger in order to maximize performance and efficiency thereof.

SUMMARY OF THE INVENTION

In accordance and attuned with the present invention, a plate-fin heat exchanger with plates that form a degas flow path that effectively convey and purge undesired air from all passages of the heat exchanger in order to maximize performance and efficiency thereof has surprisingly been discovered.

According to an embodiment of the disclosure, a heat exchanger plate is disclosed. The heat exchanger plate includes a plate including a passage forming surface. A portion of a flow passage is formed on the passage forming surface. A recess is formed in the passage forming surface and intersects the portion of the flow passage. The recess is configured to collect and receive air from the portion of the flow passage. A degas aperture is formed on the passage forming surface and configured to convey the collected air from a flow path of the heat exchanger.

According to another embodiment of the invention, a heat exchanger is disclosed. The heat exchanger includes a heat exchange assembly including an upper cover panel, a lower cover panel, a plurality of stacked plate assemblies, and a plurality of fins interposed between the plate assemblies. Each of the plate assemblies form a flow passage for receiving a coolant. A continuous flow path extends through the heat exchange assembly. The flow path is in fluid communication with the flow passages of each of the plates and is configured to convey air from each of the flow passages to an environment separate from the heat exchanger.

According to yet another embodiment of the invention, a heat exchanger is disclosed. The heat exchanger includes an upper cover panel including a degas outlet for conveying air from the heat exchanger. A lower cover panel including a groove formed therein. A plurality of plate assemblies is disposed intermediate the upper cover panel and the lower cover panel. Each of the plurality of plate assemblies form a flow passage for receiving a coolant therethrough. The plurality of plate assemblies align with each other to form at least one degas channel and at least one degas outlet manifold extending therethrough. The at least one degas channel and the at least one degas outlet manifold are configured to receive and convey air from each of the flow passages to an environment outside of the heat exchanger, the groove fluidly connecting the at least one degas channel and the at least one degas outlet manifold.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. The terms upper and lower are used for clarity only in reference to a position of a heat exchanger in a motor vehicle.

Figure 1:
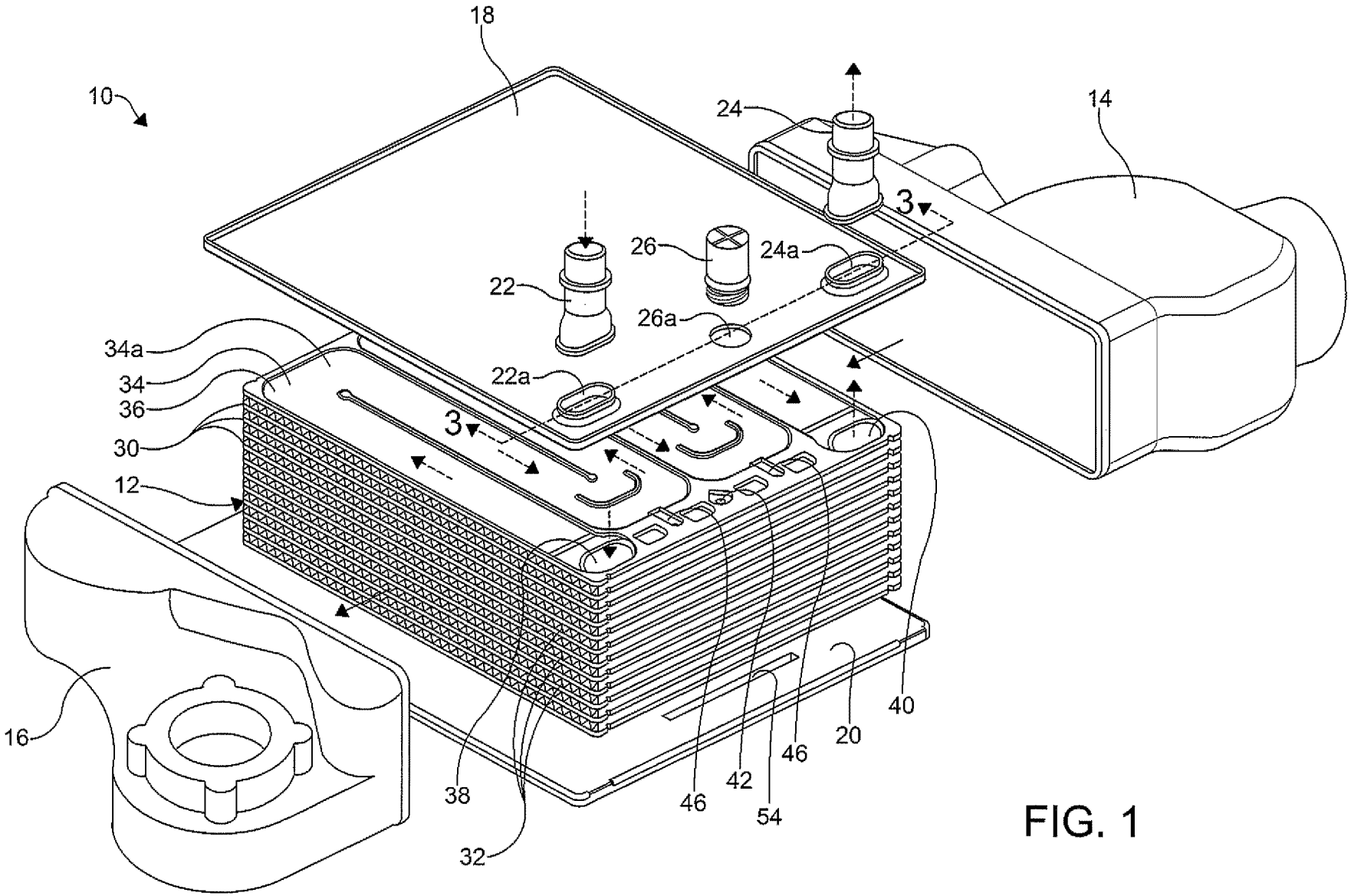
FIG. 1 is a partially exploded top perspective view of a heat exchanger according to an embodiment of the invention.
Figure 2:
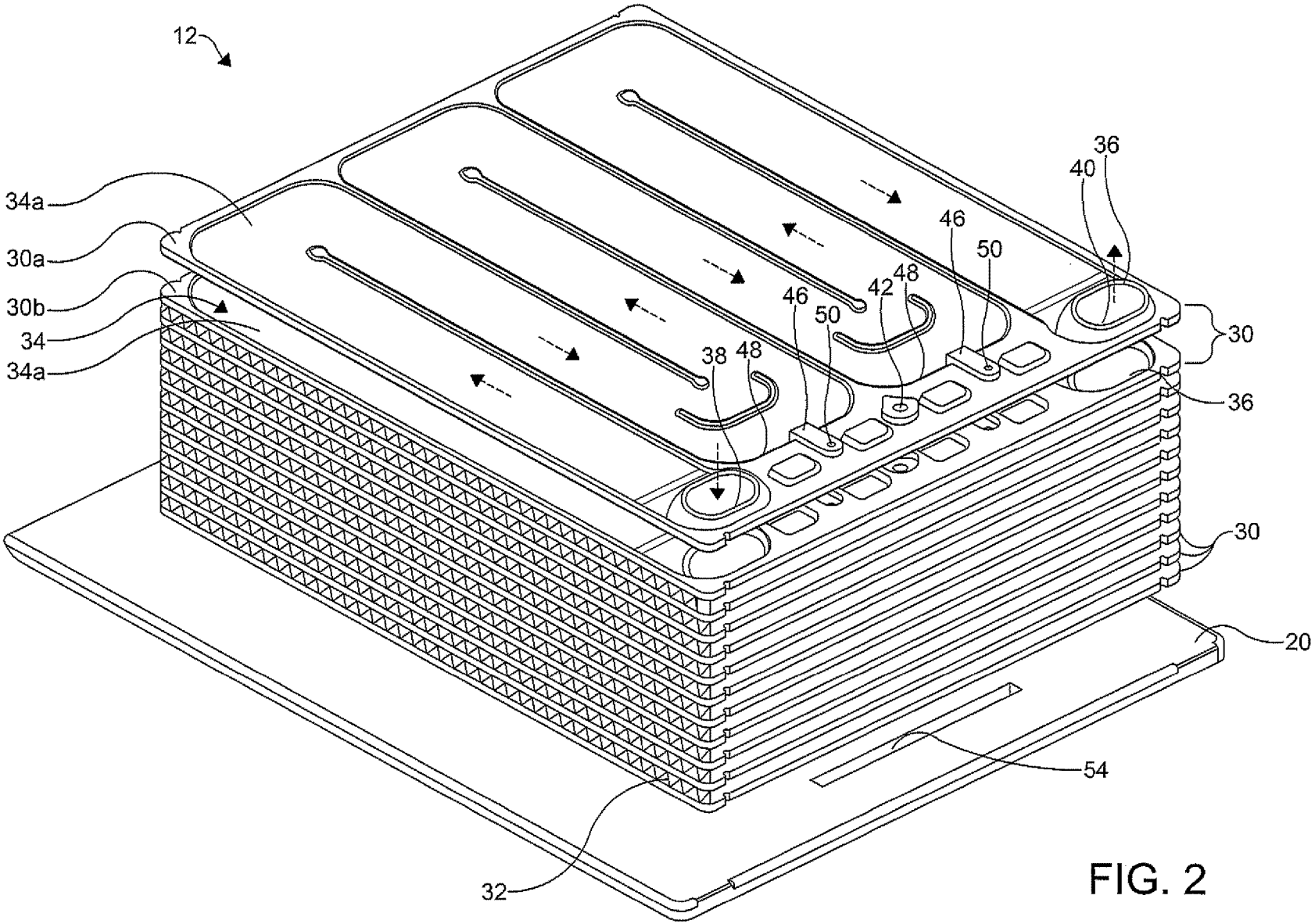
FIG. 2 is an enlarged partially exploded top perspective view of a portion of a heat exchange assembly of the heat exchanger of FIG. 1, wherein a plurality of plate assemblies, a plurality of fins, and a bottom cover panel arrangement is illustrated.
Figure 3:
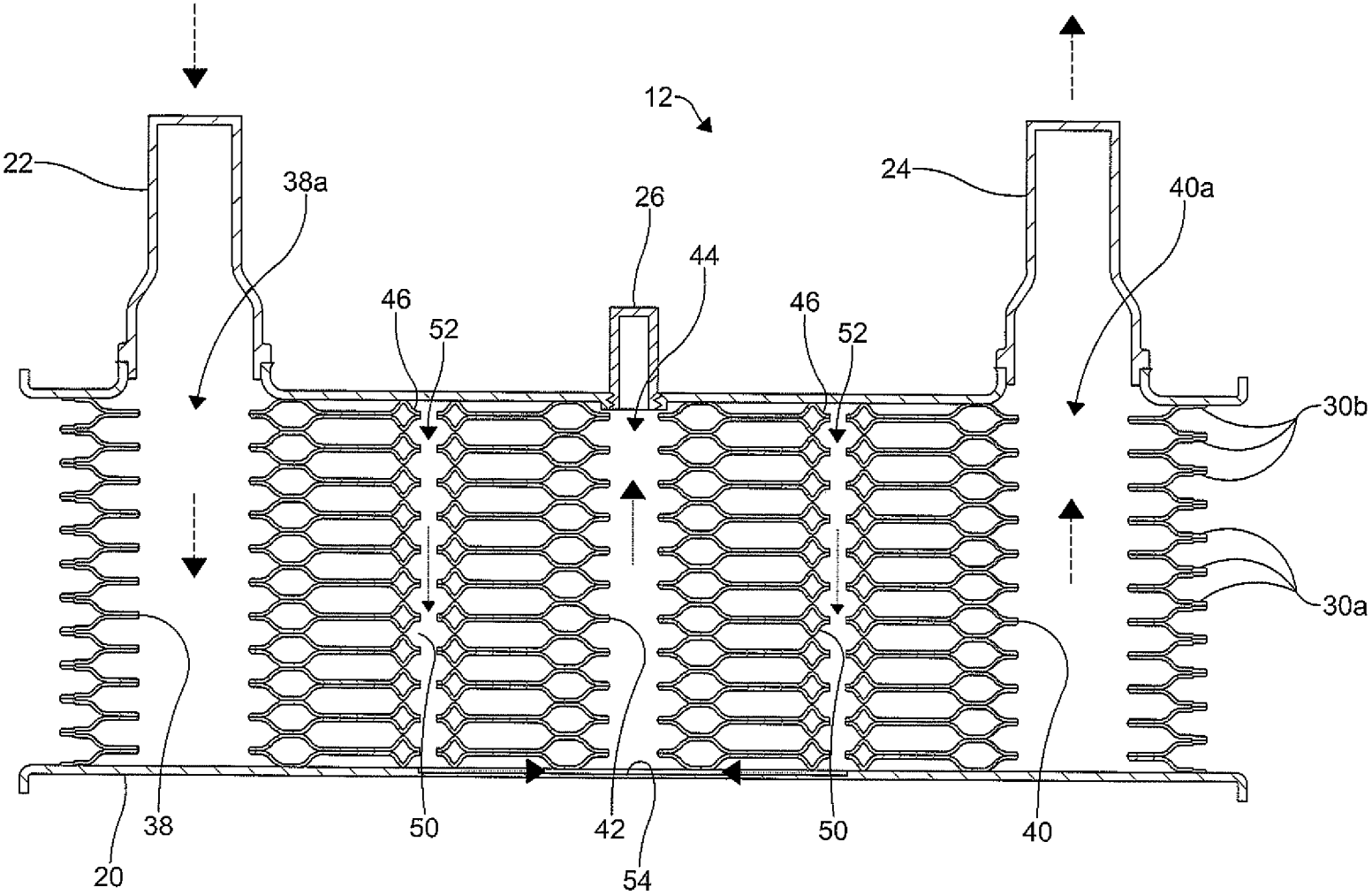
FIG. 3 is an enlarged cross-sectional elevational view of a heat exchange assembly of the heat exchanger of FIG. 1 taken along line 3-3 of FIG. 1 and showing the heat exchange assembly in a non-exploded condition.

FIGS. 1-3 illustrate a heat exchanger 10 of a motor vehicle according to an embodiment of the disclosure. The heat exchanger 10 is configured as a plate-fin heat exchanger for use in a motor vehicle. In a non-limiting example, the heat exchanger 10 is a water-cooled charge air cooler (WCAC) for use in a charge air circuit (not shown) of the motor vehicle. The charge air circuit provides the air that has been charged from a charger such as a turbocharger or a supercharger, for example, to an engine of the vehicle. The heat exchanger 10 is configured to receive and convey the air therethrough and receive and convey a coolant from a coolant circuit (not shown) of the vehicle therethrough. A flow of air through the heat exchanger 10 is indicated by solid arrows. A flow of coolant through the heat exchanger 10 is indicated by the dashed arrows.

The heat exchanger 10 includes a heat exchange assembly 12, an inlet tank 14, and an outlet tank 16. The inlet tank 14 and the outlet tank 16 are for, respectively, receiving and conveying the air flowing from the charge air circuit. The heat exchange assembly 12 is disposed intermediate the inlet tank 14 and the outlet tank 16. It is understood, the heat exchanger 10 can have any assembly configuration, as desired. The heat exchange assembly 12 can also include other various components such as additional conduits, connections, tanks, valves, and any other components for use with a heat exchanger, as desired.

The heat exchange assembly 12 includes an upper cover panel 18 and a lower cover panel 20. The upper cover panel 18 includes an inlet port 22 and an outlet port 24 disposed thereon for, respectively receiving and conveying the coolant from the coolant circuit. The upper cover panel 18 further includes a degas outlet 26 configured for purging undesired trapped air from the flow of coolant through the heat exchange assembly 12. In certain embodiments, the degas outlet 26 can be configured as a bleed screw. However, it is understood the degas outlet 26 can be a bleed valve, a bleed nipple, or any other means configured to purge undesired air from the flow of coolant through the heat exchange assembly 12. Each of the ports 22, 24 and the degas outlet 26 aligns with respective holes 22*a*, 24*a*, and 26*a* formed in the upper cover panel 18. The ports 22, 24 and the degas outlet 26 can be integrally formed with the upper cover panel 18 or separately formed from the upper cover panel 18 and coupled thereto by welding, brazing, or the like.

As shown in FIGS. 1-2, the heat exchange assembly 12 includes a plurality of stacked, substantially parallel plate assemblies 30 interposed between a plurality of substantially parallel fins 32. The plate assemblies 30 and the fins 32 are disposed between the upper cover panel 18 and the lower cover panel 20. The heat exchange assembly 12 and the covers 18, 20 are disposed intermediate the inlet tank 14 and the outlet tank 16. Each of the plate assemblies 30 defines a flow passage 34 for receiving the coolant from the coolant circuit. The fins 32 are in thermal communication with the plate assemblies 30 and are configured to allow the air flowing through the heat exchanger 10 to pass therebetween. The fins 32 are configured to facilitate heat transfer between the air flowing therethrough and the coolant flowing through each of the plate assemblies 30. The fins 32 may have a corrugated configuration, if desired.

As illustrated in FIGS. 2-3, each of the plate assemblies 30 includes a first plate 30*a* and a second plate 30*b*. Each of the plates 30*a*, 30*b* has a passage forming surface 36 with a portion 34*a* of the flow passage 34 formed thereon. The first plate 30*a* and the second plate 30*b* are joined together and cooperate with each other to form the flow passage 34 therebetween, wherein passage forming surfaces 36 of each of the plates 30*a*, 30*b* face each other. Each of the plates 30*a*, 30*b* can be formed by any processes now known or later developed such as stamping, forming, molding, etc. The plates 30*a*, 30*b* can be joined together to form the plate assemblies 30 by any process such as brazing, adhesive bonding, or welding, for example.

Each of the plates 30*a*, 30*b* includes an inlet aperture 38, an outlet aperture 40, and a degas aperture 42 formed therethrough adjacent an end thereof. Although, it is understood the inlet aperture 38, the outlet aperture 40, and the degas aperture 42 can be formed through the plates 30*a*, 30*b* at a central portion thereof, or intermediate a central portion thereof and an end portion thereof, if desired. The plate assemblies 30 are stacked wherein the inlet apertures 38 of each of the plates 30*a*, 30*b* align with each other to form an inlet manifold 38*a* extending through the plurality of plate assemblies 30. The outlet apertures 40 of each of the plates 30*a*, 30*b* of the plate assemblies 30 align with each other to form an outlet manifold 40*b* extending through the plate assemblies 30. The inlet manifold 38*a* and the outlet manifold 40*b* each receive the coolant therethrough and are configured to fluidly communicate with the inlet port 22 and the outlet port 24 and the flow passages 34 formed by each of the plate assemblies 30. The degas apertures 42 of each of the plates 30*a*, 30*b* align with each other to form a degas outlet manifold 44 configured to fluidly communicate with the degas outlet 26 to convey the undesired air from the heat exchange assembly 12.

The portions 34*a* of the flow passages 34 on each of the plates 30*a*, 30*b* form a single serpentine flow path extending from and intermediate the inlet aperture 38 and the outlet aperture 40. As shown, each of the plates 30*a*, 30*b* has a multiple parallel pass configuration, wherein the portions 34*a* of the flow passages 34 form parallel passes to direct the coolant to flow along parallel lengthwise portions of the plates 30*a*, 30*b*. In the embodiment illustrated, each of the plates 30*a*, 30*b* has a six pass parallel configuration that includes six parallel passes to direct the coolant to flow along six parallel lengthwise portions of the plates 30*a*, 30*b* from the inlet aperture 38 to the outlet aperture 40. However, it is understood that the plates 30*a*, 30*b* can have other multiple parallel pass configurations as desired. For example, the plates 30*a*, 30*b* can have a two pass parallel configuration, a four pass parallel configuration, an eight pass parallel configuration, or a ten pass parallel configuration that, respectively, includes two parallel passes, four parallel passes, eight parallel passes, or ten parallel passes to direct the coolant to flow, respectively, along two, four, eight, or ten parallel lengthwise portions of the plates 30*a*, 30*b*.

Each of the plates 30*a*, 30*b* further includes recesses 46 formed on the passage forming surfaces 36 thereof. Each of the recesses 46 intersects with a U-turn end 48 of a pair of parallel passes of the multiple parallel pass configuration and extend outwardly from the U-turn end 48 towards the end of the plate 30*a*, 30*b*. Each of the recesses 46 has a depth greater than a depth of the portion 34*a* of the flow passage 34. The recesses 46 are configured to collect and receive undesired air from the flow of coolant through the flow passages 34.

In the exemplary embodiment shown, two recesses 46 are formed in each of the plates 30*a*, 30*b*. A first one of the recesses 46 intersects with the U-turn end 48 of the second and third parallel passes of the six parallel pass configuration and a second one of the recesses 46 intersects with the U-turn end 48 of the fourth and the fifth parallel passes of the six parallel pass configuration. In another example, where the portions 34*a* of the flow passages 34 form the four parallel pass configuration, one recess 46 is formed in each of the plates 30*a*, 30*b* at the U-turn end 48 of the second and the third parallel passes. In yet another example, where the portions 34*a* of the flow passages 34 form the eight parallel pass configuration, three recesses 46 are formed in each of the plates 30*a*, 30*b* at the U-turn end 48 of the second and the third parallel passes, the U-turn end 48 of the fourth and the fifth parallel passes, and the U-turn end 48 of the sixth and the seventh parallel passes. In yet a further example, where portions 34*a* of the flow passages 34 form the ten parallel pass configuration, four recesses 46 are formed in each of the plates 30*a*, 30*b* at the U-turn end 48 of the second and the third parallel passes, the U-turn end 48 of the fourth and the fifth parallel passes, the U-turn end 48 of the sixth and the seventh parallel passes, and the U-turn end 48 of the eighth and the ninth parallel passes.

An opening 50 is formed in each of the recesses 46 and extends through each of the plates 30*a*, 30*b*. The openings 50 linearly align with the degas aperture 42 along a width of each of the plates 30*a*, 30*b*. The openings 50 of each of the plates 30*a*, 30*b* align with each other to form degas channels 52 extending through the heat exchange assembly 12. The degas channel 52 fluidly communicates with each of the flow passages 34 to receive and convey the undesired air from the flow passages 34 as the coolant flows therethrough. In the embodiment illustrated, two degas channels 52 are formed to correspond to the two recesses 46 formed in each of the plates 30*a*, 30*b*. However, more or fewer degas channels 52 can be formed depending on the number of recesses 46 formed in each of the plates 30*a*, 30*b*.

The lower cover panel 20 includes an elongated groove 54 formed on an upper surface thereof. The groove 54 is configured to provide fluid communication between the degas channels 52 and the degas outlet manifold 44. When coupled to the heat exchange assembly 12, the groove 54 aligns with each of the degas channels 52 and the degas outlet manifold 44. Each of the degas channels 52, the groove 54, and the degas outlet manifold 44 form a continuous pathway to collect and convey undesired air from the flow passages 34 of the plate assemblies 30 and to the degas outlet 26. A flow of the undesired air through the heat exchange assembly 12 is illustrated by dotted arrows in FIG. 3.

In the illustrated embodiments, the groove 54 is a continuous groove extending at a length equal to a distance between the degas channels 52 and the degas outlet manifold 44. However, it is understood the groove 54 can be a non-continuous groove, if desired. For example, the groove 54 can consist of non-continuous sections, wherein one of the sections extends at a length equal to a distance from the first one of the degas channels 52 to the degas outlet manifold 44 and another section extends at a length equal to a distance from the second one of the degas channels 52 to the degas outlet manifold 44. In embodiments with one degas channel 52, the groove 54 can extend at a distance equal to a distance from the degas channel 52 to the degas outlet manifold 44. In embodiments with more than two degas channels 52, the groove 52 can be continuous and extend at a length equal to the distance between the outermost degas channels 52 with respect to a width of the heat exchange assembly 12 and align with each of the degas channels 52 and the degas outlet manifold 44. Alternatively, the groove 52 can be non-continuous. For example, one section of the groove 54 can extend at a length equal to a distance from one of the outermost degas channels 52 to the degas outlet manifold 44 and aligns therewith and with any intermediate degas channels 52. A second section of the groove 54 can extend at a length equal to a distance from an opposing one of the outermost degas channels 52 to the degas outlet manifold 44 and aligns therewith and with any intermediate degas channels 52.

It is further understood that more than one degas outlet manifold 44, and likewise, more than one degas outlet 26, can be included in the heat exchange assembly 12, as desired. For example, the heat exchange assembly 12 can include two, three, or four degas outlet manifolds 44 and degas outlets 26 in embodiments where each of the plates 30*a*, 30*b* has six or more parallel passes. In such examples, continuous grooves 54 or multiple non-continuous grooves 54 can be included to provide fluid communication between each of the degas channels 52 with at least one of the degas outlet manifolds 44.

In application, such as during servicing of, maintenance of, or operation of the heat exchanger 10, the coolant flows through the inlet port 22 and the inlet manifold 38*a* formed by the plate assemblies 30 of the heat exchange assembly 12. The coolant is then distributed amongst each of the plate assemblies 30 from the inlet manifold 38*a*. The coolant then flows through the flow passage 34 of each of the plate assemblies 30. As the coolant flows through the flow passages 34, any undesired air that is introduced to the flow passages 34 with the flow of coolant is collected and received in the recesses 46 of each of the plates 30*a*, 30*b*. The air is then conveyed through the degas channels 52 from the openings 50 of the recesses 46 to the groove 54. The air then travels from the groove 54 to the degas outlet manifold 44, and from the degas outlet manifold 44 through the degas outlet 26 to an environment separate from the heat exchanger 10.

Advantageously, the heat exchanger 10 has a continuous degas flow path for collecting any undesired air inadvertently introduced to the flow passages 34 of the heat exchanger 10. The continuous degas flow path then conveys the air therethrough and outwardly from the heat exchanger 10, which maximizes performance and efficiency of the heat exchanger 10. The continuous degas flow path is especially advantageous in heat exchangers having plates with multiple parallel flow configurations such as plates with more than one pair of parallel passes. For example, the continuous degas path is advantageous in heat exchangers with plates having the four parallel pass configuration, the six parallel pass configuration, the eight parallel pass configuration, and the ten parallel pass configuration.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger plate comprising:

a plate including a passage forming surface;

a flow passage formed on the passage forming surface, wherein the flow passage occupies a first area of the passage forming surface, wherein the flow passage has a U-turn end;

a recess formed on the passage forming surface, wherein the recess occupies a second area of the passage forming surface, wherein the second area is different from and disposed outside of the first area on the passage forming surface, wherein a first portion of a perimeter of the flow passage coincides with a first portion of a perimeter of the recess along the U-turn end of the flow passage, and wherein the recess is configured to collect air from the flow passage; and a degas aperture formed on the passage forming surface and configured to convey the air collected from a flow path of a heat exchanger, wherein the passage forming surface includes a plurality of recesses, each of the recesses having an opening formed therein and extending through the plate.

2. The plate of claim 1, wherein the recess includes an opening formed therein.

3. The plate of claim 1, further comprising an inlet aperture configured to receive a coolant and an outlet aperture configured to convey the coolant, the flow passage extending between the inlet aperture and the outlet aperture and forming a serpentine flow path.

4. The plate of claim 3, wherein the degas aperture and the recess are disposed intermediate the inlet aperture and the outlet aperture.

5. The plate of claim 1, wherein the plate has one of a four parallel pass configuration, a six parallel pass configuration, an eight parallel pass configuration, and a ten parallel pass configuration.

6. The plate of claim 1, wherein the recess has a depth different from a depth of the portion of the flow passage.

7. The plate of claim 6, wherein the passage forming surface includes a change in depth where the first portion of the perimeter of the flow passage coincides with the first portion of the perimeter of the recess.

8. The plate of claim 1, wherein the passage forming surface further includes a planar portion occupying a third area of the passage forming surface, wherein the third area is different from each of the first area and the second area, wherein the flow passage is recessed relative to the planar portion and the recess is recessed relative to the planar portion.

9. The plate of claim 8, wherein a second portion of the perimeter of the flow passage is present at a boundary along which the planar portion meets the flow passage and a second portion of the perimeter of the recess is present at a boundary along which the planar portion meets the recess.

10. The plate of claim 8, wherein the second portion of the perimeter of the flow passage meets the second portion of the perimeter of the recess along the U-turn end.

11. The plate of claim 10, wherein the second portion of the perimeter of the flow passage is arranged perpendicular to the second portion of the perimeter of the recess where the second portion of the perimeter of the flow passage meets the second portion of the perimeter of the recess.

12. The plate of claim 8, wherein the flow passage is recessed at a depth relative to the planar portion that is different than a depth the recess is recessed relative to the planar portion.

13. The plate of claim 1, wherein the U-turn end connects a first pass of the flow passage to a second pass of the flow passage, wherein the first portion of the perimeter of the flow passage is arranged perpendicular to a direction of extension of each of the first pass and the second pass.

14. A heat exchanger plate comprising:

a plate including a passage forming surface;

a flow passage formed on the passage forming surface, wherein the flow passage occupies a first area of the passage forming surface, wherein the flow passage has a U-turn end;

a recess formed on the passage forming surface, wherein the recess occupies a second area of the passage forming surface, wherein the second area is different from and disposed outside of the first area on the passage forming surface, wherein a first portion of a perimeter of the flow passage coincides with a first portion of a perimeter of the recess along the U-turn end of the flow passage, and wherein the recess is configured to collect air from the flow passage; and a degas aperture formed on the passage forming surface and configured to convey the air collected from a flow path of a heat exchanger, wherein the recess extends longitudinally away from the first portion of the perimeter of the flow passage, wherein the U-turn end connects a first pass of the flow passage to a second pass of the flow passage, wherein the recess extends longitudinally in a direction parallel to a direction of extension of each of the first pass and the second pass.

15. The plate of claim 14, wherein the recess extends longitudinally away from a center of the U-turn end.

16. A heat exchanger plate comprising:

a plate including a passage forming surface;

a flow passage formed on the passage forming surface, wherein the flow passage occupies a first area of the passage forming surface, wherein the flow passage has a U-turn end;

a recess formed on the passage forming surface, wherein the recess occupies a second area of the passage forming surface, wherein the second area is different from and disposed outside of the first area on the passage forming surface, wherein a first portion of a perimeter of the flow passage coincides with a first portion of a perimeter of the recess along the U-turn end of the flow passage, and wherein the recess is configured to collect air from the flow passage; and a degas aperture formed on the passage forming surface and configured to convey the air collected from a flow path of a heat exchanger, wherein the plate extends longitudinally from a first end to a second, wherein the U-turn end of the flow passage is disposed adjacent the first end of the plate, and wherein the recess is formed on the passage forming surface between the U-turn end of the flow passage and the first end of the plate.

17. The plate of claim 16, wherein the recess extends away from the first portion of the perimeter of the flow passage in a direction towards the first end of the plate.

* * * * *